United States Patent [19]

Tomczak

[11] 4,005,861

[45] Feb. 1, 1977

[54] POCKET-BILLIARD TRICK SHOT RACKING DEVICE

[76] Inventor: Kenneth R. Tomczak, 12053 Brougham, Sterling Heights, Mich. 48077

[22] Filed: June 12, 1975

[21] Appl. No.: 586,221

[52] U.S. Cl. ..... 273/22

[51] Int. Cl.[2] ..... A63D 15/00

[58] Field of Search ..... 273/22

[56] References Cited

UNITED STATES PATENTS

| | | | |
|---|---|---|---|
| 3,672,671 | 6/1972 | Merola | 273/22 |
| 3,825,258 | 7/1974 | Frierman | 273/22 X |

OTHER PUBLICATIONS

Billiards For Everyone by Luther Lassiter, 2–1972, p. 82.

*Primary Examiner*—Paul E. Shapiro
*Attorney, Agent, or Firm*—William L. Fisher

[57] ABSTRACT

Improved pocket-billiard trick shot racking device, whereby to facilitate making pocket-billiard trick shots, the racking device being a four-sided racking device having four walls and a trapezoidal shape in plan view so that it can rack six billiard balls at a time so that four thereof are disposed in the corners of said racking device each touching two walls of said device and the other two thereof are inside of the corner balls, the two innermost balls touching two of the corner balls and being spaced apart from each other so that the space between them is less than the diameter of the cue ball, the walls having inside dimensions of length precisely machined to one thousandth of an inch the walls having inside dimensions of length for any given diameter of billiard balls as follows: the front; rear; and side walls, respectively, being 3.717 diameters; 3.171 diameters; and 2.846 diameters.

3 Claims, 4 Drawing Figures

POCKET-BILLIARD TRICK SHOT RACKING DEVICE

My invention relates to the game of pocket-billiards.

The principal object of my invention is to provide an improved pocket-billiard trick shot racking device, whereby to facilitate making pocket-billiard trick shots.

Figure 1:
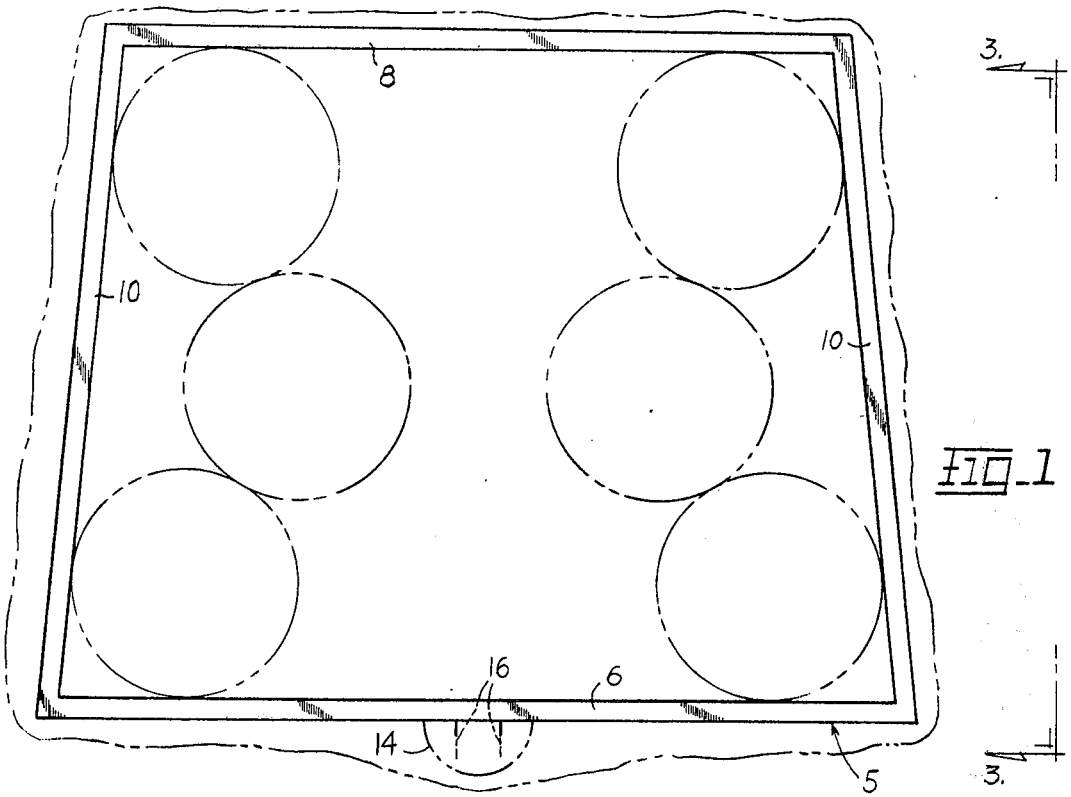
Figure 2:
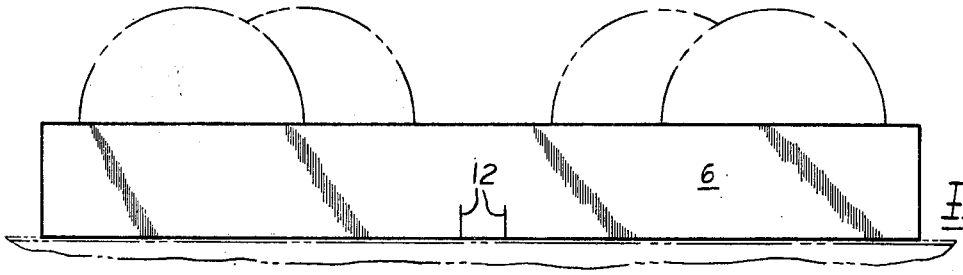
Figure 3:
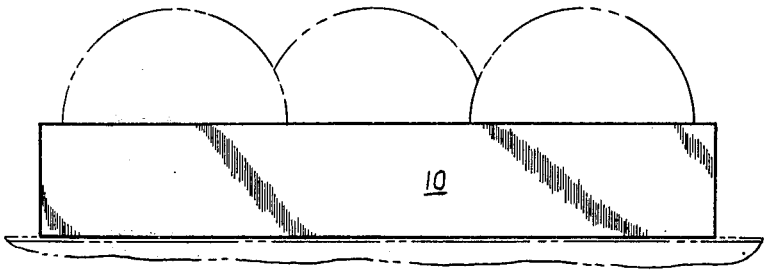
Figure 4:
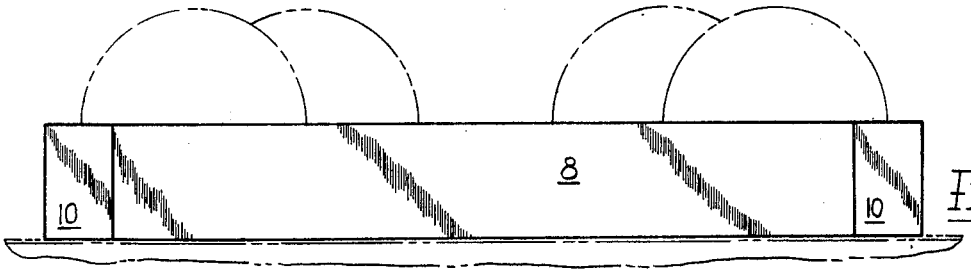

The foregoing object of my invention and the advantages thereof will become apparent during the course of the following description, taken in conjunction with the accompanying drawings, in which:

FIGS. 1–4 are, respectively, top plan, front, side and rear elevational views of a billiard trick shot racking device embodying my invention.

Referring to the drawings in greater detail, 5 generally designates said embodiment which comprises a four-sided pocket-billiard racking device having front, rear and opposite side walls 6, 8 and 10, respectively, and a trapezoidal shape in plan view. For a given size of billiard balls, the walls 6, 8 and 10 must have precise inside dimensions of length in order to make the trick shots I have been able to make with said racking device 5. These dimensions will be stated hereinafter. Said racking device 5 racks six billiard balls so that four of them are disposed in the corners of said rack (two touching the rear and side walls 8 and 10 and two touching the front and side walls 6 and 10) and two of them inside of the other four each touching two of the corner balls and so that the space between said inside balls is less than the diameter of the cue ball (the diameter of the cue ball being the same as that of the other balls). Said racking device 5 has spot marks 12 on the outside face of said front wall 6 which are made to coincide with matching spot marks 16 on a semi-circular spot 14 which is placed on the felt of a regulation pocket-billiard table (i.e., one having a length twice its width) having the usual six pockets (i.e., four corner and two middle pockets). Every regulation pocket-billiard table has transverse one-eighth length lines marked on the longitudinal rails thereof with pairs of spots. The head spot where the cue ball is placed is usually on the second one-eighth line from the head end of the table. The foot spot where the 15 balls are racked is usually on the second one-eighth line from the foot end of the table. These one-eighth lines will be mentioned, infra, in connection with placement of my racking device 5 on the table. The racking device 5 is positioned on said felt so that the front wall 6 is closer to the head end of the table than the foot end. Specifically, the spot 14 is positioned widthwise of the table so that the longitudinal centerline thereof passes midway between said spot marks 16. The spot 14 is positioned lengthwise of the table so that the rack 5 is approximately centered on the third one-eighth line from the head end of the table. Since regulation tables can vary in length of playing area from 6 to 9½ feet this lengthwise positioning of the racking device 5 will be exactly on the third one-eighth line for some tables and for other tables an inch or so closer to the head or foot end, depending upon the particular table. With the racking device 5 so positioned with six billiard balls therein, as shown, and subsequently removed therefrom in the usual manner said six billiard balls will be exactly positioned or racked for making a trick shot. Said trick shot is made by shooting a cue ball from the head end of the table so that it is aimed to pass midway between the two innermost balls and when it so travels it strikes them and drives them into the opposite middle pockets and drives the two balls touching the front wall 6 into the two corner pockets at the head end of the table and the two balls touching the rear wall 8 into the two corner pockets at the foot end of the table.

I have found that said walls must have the following inside dimensions: the front wall 6: 8.364 inches; the back wall 8: 7.136 inches; and each side wall 10: 6.403 inches for 2¼ inch diameter balls. Similarly, for 2⅛ inch diameter billiard balls, the front wall 6 must be 7.899 inches; the back wall 8: 6.739 inches; and each side wall 10: 6.047 inches.

With a racking device 5 constructed as shown many other intriguing trick shots can be made than that described such as the following, which will be explained by using arbitrary numbers for the six pockets on a regulation pockets-billiard table. Assuming one is viewing said table in plan view while standing at the head end of the table the pockets will be considered consecutively numbered clockwise commencing with the pocket in the upper right hand corner of said table. Thus the two corner pockets at the foot end of the table will be numbered 1 and 6; the two middle pockets 2 and 5; and the two corner pockets at the head end of the table 3 and 4. Likewise the rails between pockets will be considered consecutively numbered clockwise commencing with the foot rail as rail No. 1; the two right side rails as rails Nos. 2 and 3; the head rail as rail No. 4; and the two left side rails as rails Nos. 5 and 6.

Each of the following trick shots is made as described, supra, by shooting the cue ball from the head end of the table so that it is aimed to pass midway between the two innermost balls and when it so travels it strikes them and drives them and the other balls into the particular pockets enumerated below.

Four Ball Shots

After racking, as described, is completed, the left hand corner ball touching the walls 8 and 10 and the left hand corner ball touching the wall 6 and 10 are both removed. Three balls are pocketed individually into pockets Nos. 1, 2 and 3. The fourth ball is pocketed into pocket No. 1 after first banking off rail No. 6. Alternately, the right hand corner ball touching the walls 8 and 10 and the right hand corner ball touching the walls 6 and 10 are both removed. Three balls are pocketed individually into pocket Nos. 4, 5 and 6. The fourth ball is pocketed into pocket No. 6 after first banking off rail No. 2.

Five Ball Shots

After racking, as described, is completed, the right hand corner ball touching the walls 6 and 10 is removed and the right hand corner ball touching the walls 8 and 10 is repositioned closer to rail No. 5. Four balls are pocketed individually into pockets Nos. 2, 4, 5 and 6 and the fifth ball is also pocketed into pocket No. 6. Alternately, the left hand corner ball touching the walls 6 and 10 is removed and the left hand corner ball touching the walls 8 and 10 is repositioned closer to rail No. 3. Four balls are pocketed individually into pockets Nos. 1, 2, 3 and 5 and the fifth ball is also pocketed into pocket No. 1.

Six Ball Shots

After racking, as described, is completed, the right hand corner ball touching the walls 8 and 10 is moved closer to rail No. 3. Four balls are pocketed individually into pockets Nos. 2, 4, 5 and 6. Two balls are pocketed into pocket No. 3 with one of the first banking off rails Nos. 2, 1 and 6. Alternately, the left hand corner ball touching the walls 8 and 10 is moved closer to rail No. 5. Four balls are pocketed individually into pockets Nos. 1, 2, 3 and 5. Two balls are pocketed into pocket No. 6 with one of them first banking off rails Nos. 6, 1 and 2.

Seven Ball Shot

After racking, as described, is completed, a seventh ball is positioned immediately in front of any one of the pockets 1–6. Six balls are pocketed individually into pockets Nos. 1–6 and the seventh ball is pocketed into the pocket immediately behind it.

Eight Ball Shot

After racking, as described, is completed, seventh and eighth balls are positioned immediately in front of any two of the pockets Nos. 1–6. Six balls are pocketed individually into the pockets Nos. 1–6 and the seventh and eighth balls are pocketed into the two respective pockets immediately behind them.

Nine Ball Shot

After racking, as described, is completed, seventh, eighth and ninth balls are positioned immediately in front of any three of the pockets Nos. 1–6. Six balls are pocketed individually into the pockets Nos. 1–6 and the seventh, eighth and ninth balls are pocketed into the three respective pockets immediately behind them.

10 Ball Shot

After racking, as described, is completed, seventh, eighth, ninth and tenth balls are positioned immediately in front of any four of the pockets Nos. 1–6. Six balls are pocketed individually into the pockets 1–6, and the seventh, eighth, ninth and 10th balls are pocketed, into the four respective pockets immediately behind them.

11 Ball Shot

After racking, as described, is completed, seventh, eighth, ninth, tenth and eleventh balls are positioned immediately in front of any five of the pockets Nos. 1–6. Six balls are pocketed individually in the pockets Nos. 1–6 and the seventh, eighth, ninth, 10th and 11th balls are pocketed into the five respective pockets immediately behind them.

12 Ball Shot

After racking, as described, is completed, seventh, eighth, ninth, 10th, 11th and 12th balls are positioned in front of each of the pockets Nos. 1–6. Six balls are individually pocketed into pockets Nos. 1–6 and the seventh, eighth, ninth, 10th, 11th and 12th balls are pocketed into the six respective pockets immediately behind them.

Three Ball Shots

After racking, as described, is completed, three balls on the left side are removed. The three remaining balls are pocketed individually into pockets Nos. 1, 2 and 3. Alternately, three balls on the right side are removed. The three remaining balls are pocketed into pockets Nos. 4, 5 and 6.

It will thus be seen that there has been provided by my invention improved billiard trick shot means and method in which the object hereinabove set forth, together with many thoroughly practical advantages, has been successfully achieved. The construction described of the racking device and its precise dimensions have been found to be absolutely essential to produce the results set forth of the many intriguing trick shots that can be made using said rack 5. These results are entirely unexpected when it is considered that because of such construction and dimensions of the racking device 5 amateurs can make these trick shots which normally can be made only by professionals. While a preferred embodiment of my invention has been shown and described, it is to be understood that variations and changes may be resorted to without departing from the spirit of my invention as defined by the appended claims.

What I claim is:

1. Improved pocket-billiard trick shot racking device, whereby to facilitate making pocket-billiard trick shots, said racking device being a four-sided racking device having four walls and a trapezoidal shape in plan view so that it can rack six billiard balls at a time so that four thereof are disposed in the corners of said racking device each touching two walls of said device and the other two thereof are inside of said corner balls, said two innermost balls touching two of said corner balls and being spaced apart from each other so that the space between them is less than the diameter of the cue ball said walls having inside dimensions of length for any given diameter of billiard balls as follows: the front; rear; and side walls, respectively, being 3.717 diameters; 3.171 diameters; and 2.846 diameters.

2. Improvement as claimed in claim 1, said walls having inside dimensions of length for 2¼ inch diameter billiard balls as follows: the front; rear; and side walls, respectively, being 8.364 inches; 7.136 inches; and 6.403 inches.

3. Improvement as claimed in claim 1, said walls having inside dimensions of length for 2⅛ inch diameter billiard balls as follows: the front; rear; and side walls, respectively, 7.899 inches; 6.739 inches; and 6.047 inches.

* * * * *